United States Patent [19]

Luthi

[11] 4,136,629

[45] Jan. 30, 1979

[54] METHOD OF PRODUCING CAN COVERS AND CAN COVERS OBTAINED THEREBY

[75] Inventor: Rudolf Lüthi, Niederwangen, Switzerland

[73] Assignee: Styner & Bienz A.G., Niederwangen, Switzerland

[21] Appl. No.: 804,366

[22] Filed: Jun. 7, 1977

[30] Foreign Application Priority Data

Jun. 14, 1976 [CH] Switzerland ..... 7491/76
Dec. 9, 1976 [CH] Switzerland ..... 15485/76

[51] Int. Cl.[2] ..... B21D 51/44
[52] U.S. Cl. ..... 113/121 C; 113/15 A
[58] Field of Search ..... 113/15 R, 15 A, 113 R, 113/116 V, 116 Y, 121 R, 121 C, 1 F; 220/266, 268, 276

[56] References Cited

U.S. PATENT DOCUMENTS

| | | | |
|---|---|---|---|
| 1,799,863 | 4/1931 | O'Neil | 113/121 C |
| 1,975,979 | 10/1934 | Sebell | 113/1 F |
| 2,915,166 | 12/1959 | Grover | 113/114 R |
| 3,245,370 | 4/1966 | Bofinger | 113/15 A |
| 3,272,166 | 9/1966 | Henchert | 113/121 C |
| 3,583,348 | 6/1971 | Brown | 113/15 A |
| 3,999,495 | 12/1976 | Rouse et al. | 113/113 R |

*Primary Examiner*—Michael J. Keenan
*Attorney, Agent, or Firm*—Imirie, Smiley & Guay

[57] ABSTRACT

A method for producing a cover for a tin or can is disclosed wherein the cover just prior to forming a weakening scoring thereon is orientated in a definite direction. Apparatus for carrying out such method is also disclosed comprising an alignment station provided at the entry to at least one processing device, said alignment station having means for rotating each cover and means for stopping said cover in a definite rotary position. A cover produced by such method is disclosed, said weakening scoring in said region transverse to the grain direction of said cover being made deeper than said weakening scoring parallel to the direction of rolling.

10 Claims, 12 Drawing Figures

FIG.1
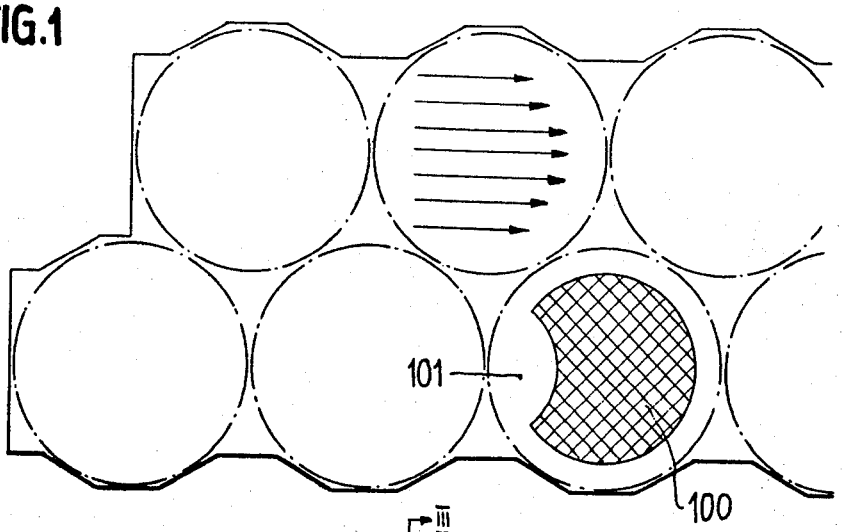
FIG.2
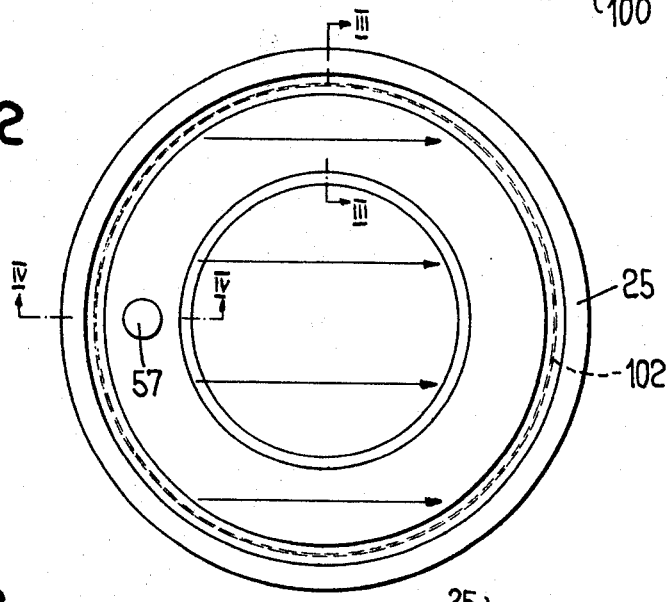
FIG.3
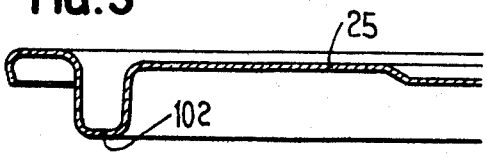
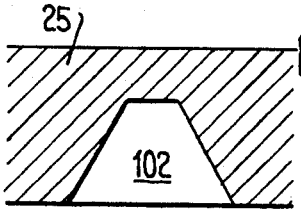
FIG.3a
FIG.4
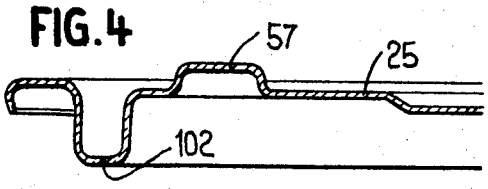
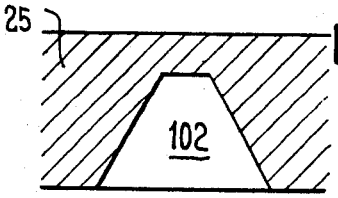
FIG.4a

METHOD OF PRODUCING CAN COVERS AND CAN COVERS OBTAINED THEREBY

Tins or cans having a cover adapted to be torn open along a weakening scoring are generally known. Production of such tins cans, or the covers thereof, is delicate and accordingly costly. It is particularly difficult to find a useful compromise between the requirements of making the cover sufficiently strong that, when the weakening score is applied or during sterilising the tin, the cover does not tear and on the other hand the requirement of being able readily to start the tear and tear open the cover along the weakening score.

Such cans covers adapted to be torn open mostly have an asymmetrical unevenness, for example an asymetrical raised portion at which a tear ring of an easy-open cover is secured.

Hitherto such and similar asymmetrical unevennesses in covers were not drawn until the metal sheets are printed and punched out of the cover in the actual multiple tool for producing the cover. Since herewith it has never been established in which rotary position the raised portion is located during the drawing of the unevenness or at which position of the cover finally the tear ring is secured, the cover had to be so imprinted that the illustration or information shown thereon, even after the mounting of a tear strip, should still be perfectly noted. Therefore, it had to be necessary either for the information to be applied to the cover to be applied only in the centre within the tear strip or, however, to print the same illustration on two halves of the cover. In both cases, the utilising of the avilable cover surface is very unfavourable, whereby in the latter case it cannot be excluded that finally the tear strip covers a certain portion of both cover halves bearing the same printing.

The object of the present invention is based on aligning all essential phases of manufacture so that the deformation and imprinting may be optimal.

According to the present invention there is provided a method of producing a cover for a can having a weakening scoring for tearing it open, in which the cover, at the latest just prior to forming the weakening scoring, is orientated in a definite direction.

This makes it possible to take into account the anisotropic properties of the raw material used for manufacture of the cover. It has namely been shown that rolled sheet for manufacturing the cover varies in strength parallel and transversely to the grain direction. The strength parallel to the grain direction is greater than that transverse to the grain direction of rolling. Proceeding from this knowledge, the method in accordance with the invention may be so carried out that the cover material is fed into the apparatus for impressing or embossing the weakening scoring aligned in accordance with its grain direction, and that the positions of the weakening scoring extending normal to the grain direction are made more deeply than the positions extending parallel to the grain direction. With this arrangement a uniform strength of the weakened point along the weakening scoring is obtained, which permits, with sufficient strength of the cover the tearing and tearing open of the weakened point to be effected in all cases optimally and as readily possible. The tearing position is preferably located at a point where the score line is perpendicular to the grain direction, thus at a point where the weakening score has its maximum depth. Hence the often problematic tearing can be particularly facilitated without the whole strength of the can cover having to be impaired. The depth of the weakening scoring may be continuously stepped and hence adapted optimally to the strength of the material at all points.

When producing rectangular covers, the grain direction may already be taken into account during the punching out of the covers from metal sheets. The covers, then in a predetermined direction, arrive in the apparatus for embossing the weakening score and forming the rivet for attachment of the tab. The scoring tool is so formed that the weakening score at the portions perpendicular to the grain direction of rolling is deeper than at the portions extending parallel to the grain direction.

The method in accordance with the invention may also be used for predetermining an asymmetric unevenness on the cover in such a manner that an illustration of the cover may fully cover the whole area not concealed by the tab or the like auxiliary device. In this case the unevenness is produced at the latest during the punching of the cover, and the cover when entering further processing devices, on account of its unevenness is caused to assume a predetermined rotary position. Usually the cover is printed on before punching, such that when punching the cover from metal sheets or metal strips, the orientation of the illustration on the cover is clearly stated. Hence it is sufficient, in this period of time to produce the unevenness which during the subsequent processing of the cover permits the cover to be accurately orientated and to be processed in the correct position, for example, provide it with a tab.

The apparatus in accordance with the invention for carrying out the method mentioned above is characterised by the feature that at the entry of at least one processing device, an alignment station is provided which has means for turning each cover and means for stopping the cover in a certain rotary position, e.g. at least one stop for an unevenness of the cover. Preferably one turntable is provided on which the cover may be loosely placed and on which the cover in turned therewith until an uneven point thereof strikes against a stop. This permits the cover to be accurately aligned, whereby this alignment occurs in one operation. However, to accelerate the operation preferably two successive operations are utilised, the first roughly aligning the cover and the second finely aligning the cover.

The present invention will be further illustrated, by way of example, with reference to the accompanying drawings, in which:

FIG. 1 is a metal strip from which covers are to be punched;

FIG. 2 is a punched out cover;

FIG. 3 is a section taken on the line III — III of FIG. 2;

Figure 5:
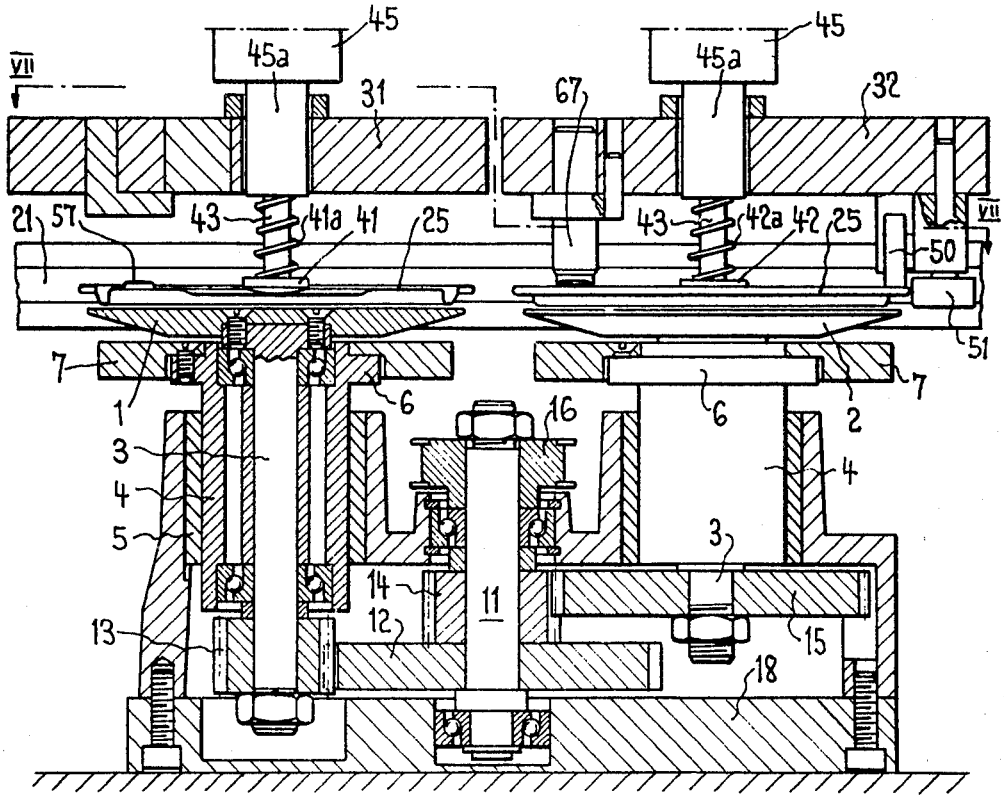
Figure 8:
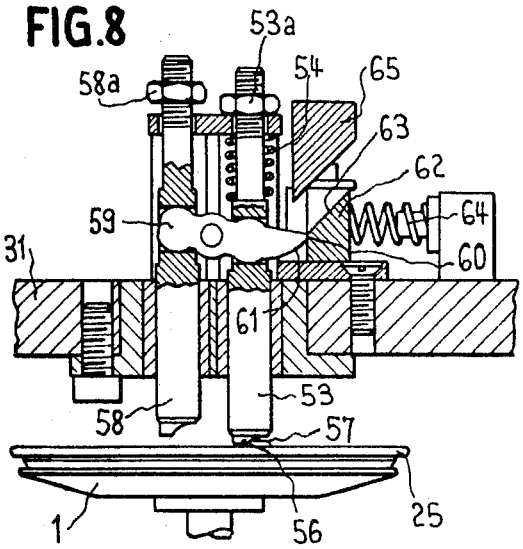
Figure 9:
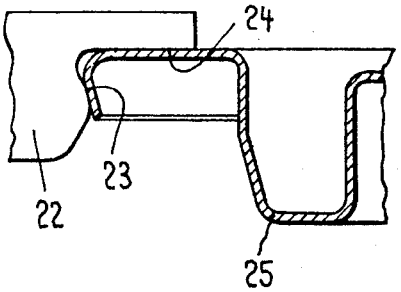
Figure 6:
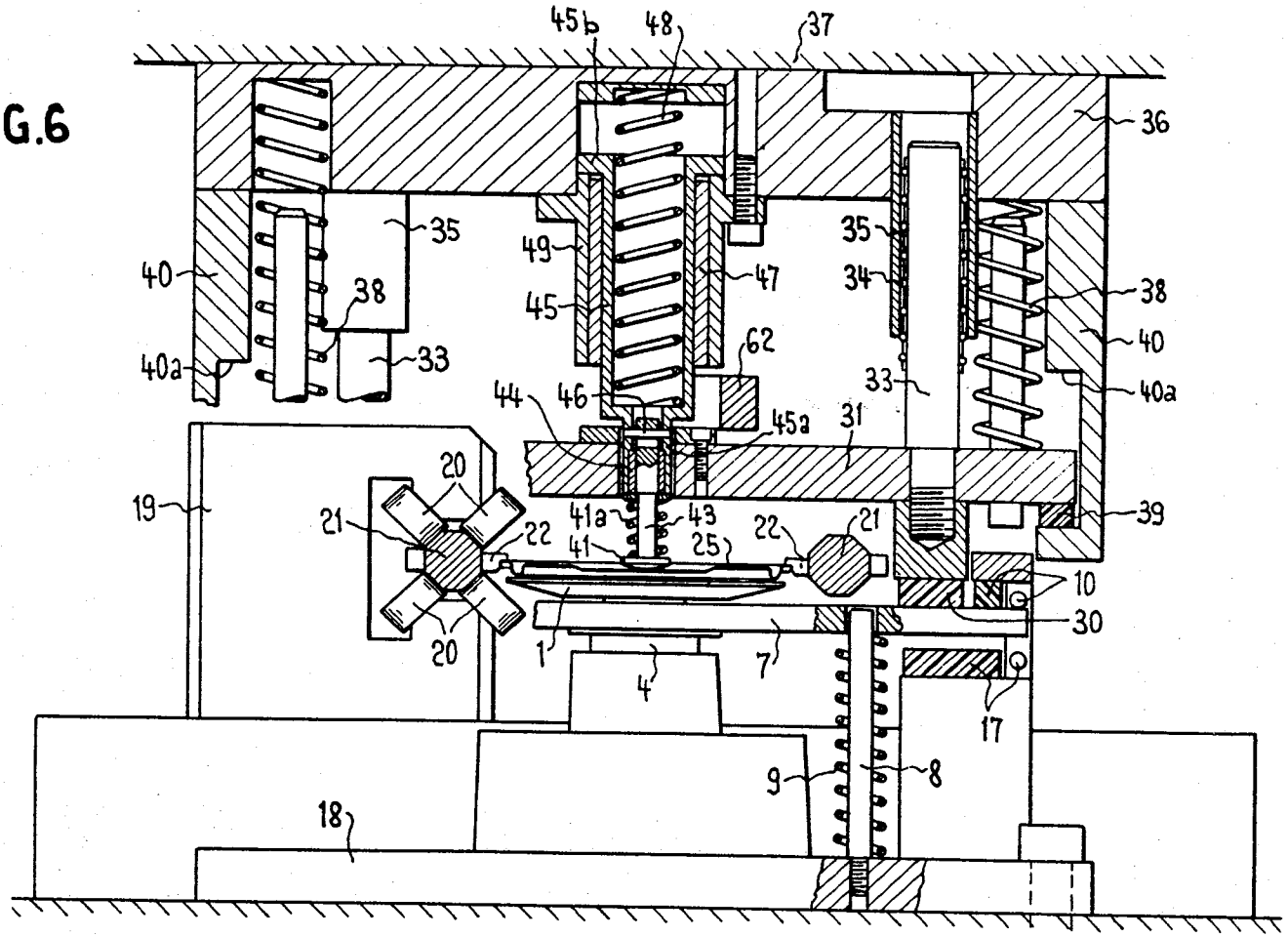
Figure 7:
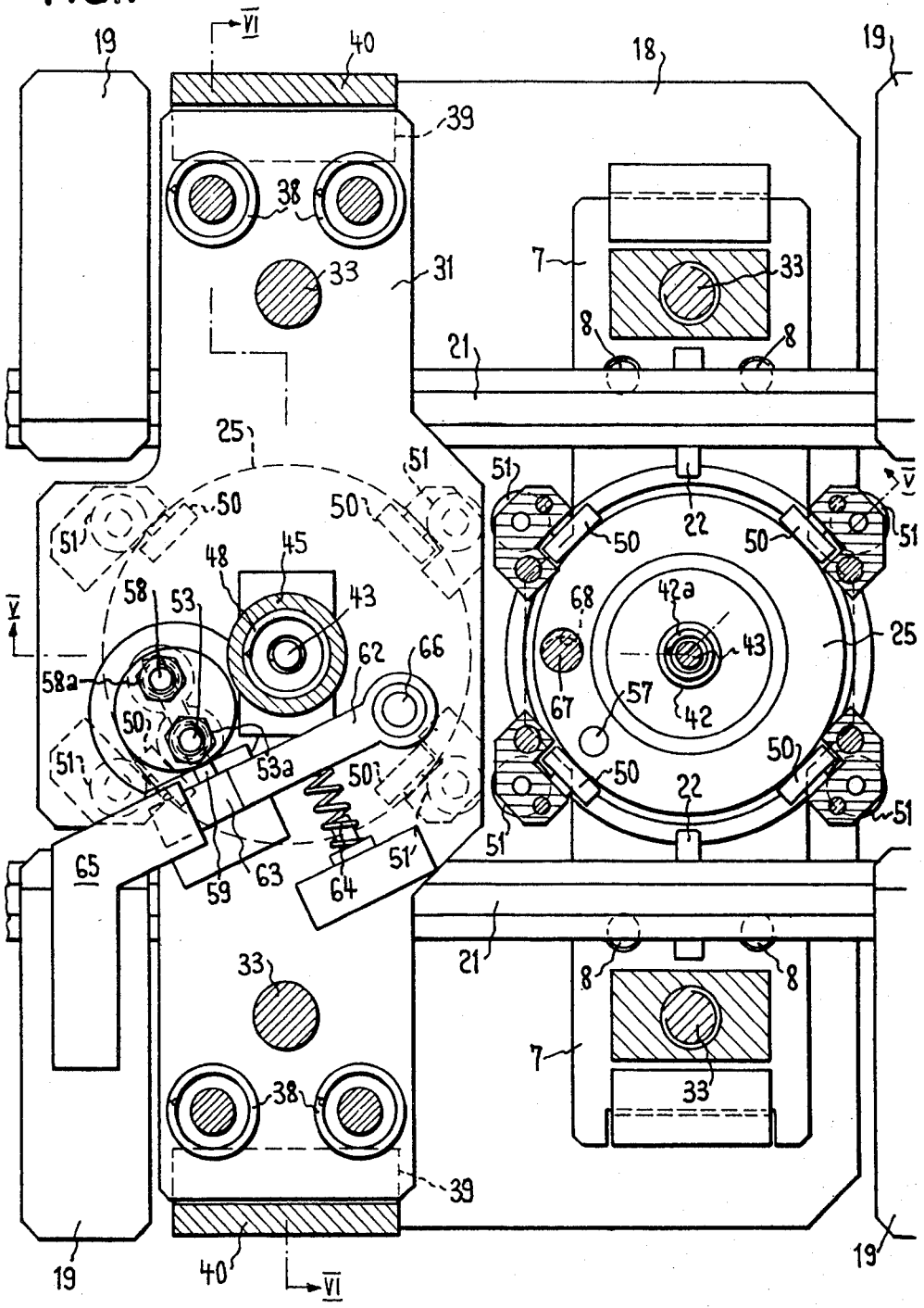
Figure 10:
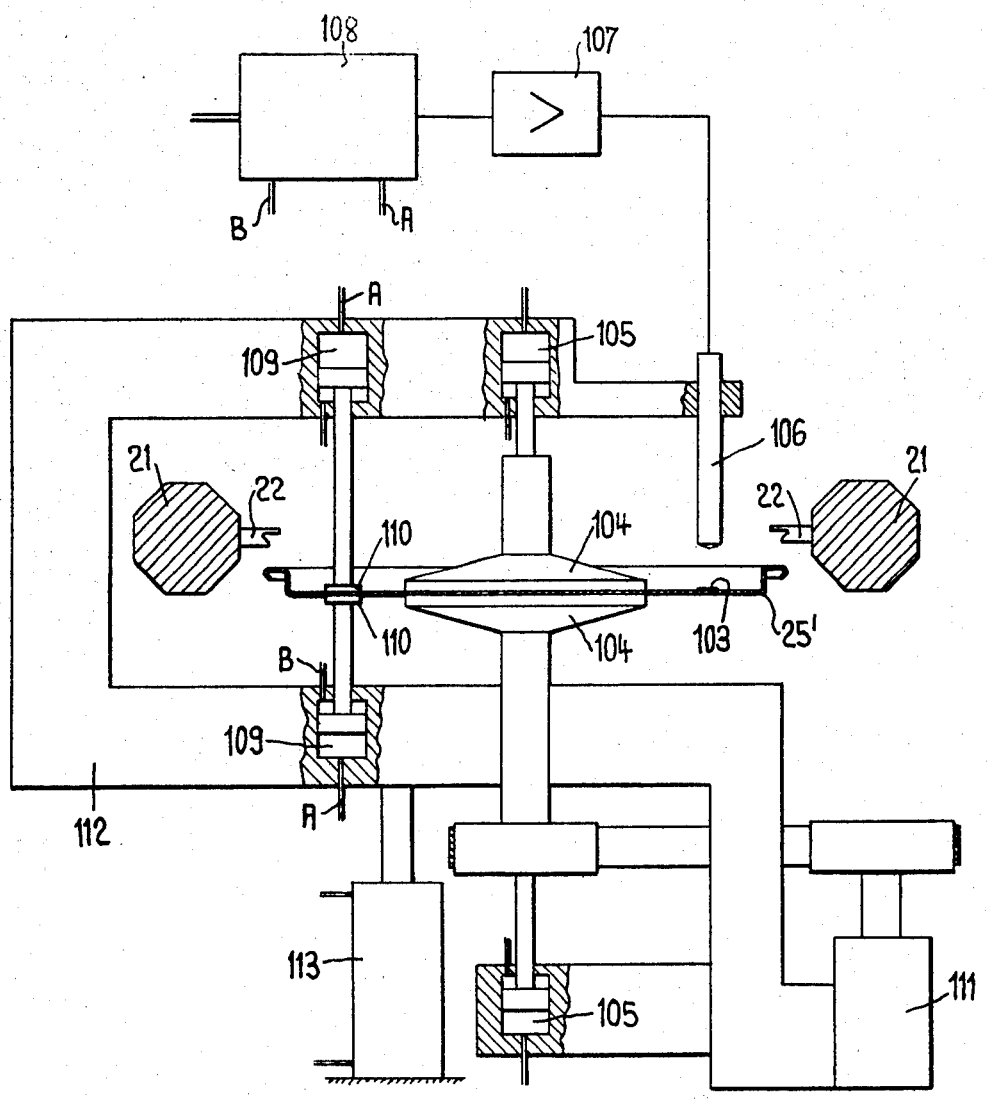

FIG. 3*a* is an enlarged fragmentary section taken on the line III — III of FIG. 2;

FIG. 4 is a section taken on the line IV — IV of FIG. 2;

FIG. 4*a* is an enlarged fragmentary section taken on the line IV — IV of FIG. 2;

FIG. 5 is a longitudinal section through an alignment station taken on the line V — V of FIG. 7;

FIG. 6 is a cross-section through the alignment station taken on the line VI — VI of FIG. 7;

FIG. 7 is a section taken on the line VII — VII of FIG. 5;

FIG. 8 is a section through a stop device;

FIG. 9 is a fragmentary section through the edge of a cover and a cover holder; and FIG. 10 is a further embodiment of an alignment station.

The procedure for producing a cover is based, in known manner, on a rolled sheet, which is first printed and then cut into scrolled strips as per FIG. 1. In one of the circles designating the covers, arrows indicate the grain direction, which extends in the longitudinal direction of the scrolled strip. In a further circle, cross hatching indicates the area 100 which has an illustration e.g. a picture and writing printed thereon. At a definite point, an unprinted area 101 is left at which, later on, the tab is applied.

The strip in accordance with FIG. 1 then arrives at a punch device, in which, in conventional manner, the cover 25 is punched out, and provided with a raised portion 57 in the area 101, the tab, later on being applied at such raised portion.

The raised portion 57, after punching the cover, may be used at any time for its alignment in the alignment station shown in FIGS. 5–8. This alignment station has two alignment positions located one behind the other, each having a turntable 1 or 2. As shown in FIG. 5, the turntables 1 and 2 are each mounted on a shaft 3, itself mounted in a sleeve 4. The sleeve 4 is non-rotational, and is guided, vertically displaceable, in a bushing 5. Each sleeve 4, at its upper end, has a flange 6 which is screwed to a plate 7. Each plate 7 is mounted, vertically displaceable, in an upright 8, one of which is shown in FIG. 6. Each upright 8 is retained in the upper end position shown by compression springs 9, such position being determined by a buffer or stop 10 (FIG. 6). The shaft 3 of the turntable 1 is driven by a drive shaft 11 via a gearwheel 12 and a pinion 13, whilst the shaft 3 of the turntable 2 is driven by the drive shaft 11 via a pinion 14 and a gearwheel 15. The shaft 11 in turn is driven by a belt, not shown, passing over a pulley 16. The axially relatively long pinions 13 and 14 permit a vertical reciprocating movement of the shafts 3 and the turntables 1 and 2 mounted thereon. The stroke of this movement is determined by the stops 10 and lower buffers or stops 17 for the plates 7.

The base plate 18, on which the hitherto described components are mounted, has supports 19 secured thereto in which, by means of ball bearings 20, feed bars 21 of octagonal cross-section are displaceably mounted in the longitudinal direction. The conveyor rods 21 may be reciprocated and serve for the conveying of covers from one processing station to another, not only in the regions of both alignment positions shown, but also in regions of processing positions possibly located in front of the alignment position and especially in the region of a subsequent multiple tool for processing aligned covers. Displaceable spring-loaded holders 22 are provided on the feed bars 21 normal to the longitudinal extension or direction of conveying the covers. FIG. 9 shows a section through the internal engaging edge of such a holder, which due to an inclined holding surface 23 and a stop surface 24 permits engagement of the pre-formed edge of a cover 25 in a definite position.

Intermediate plates 31 and 32 are provided over the turntables 1 and 2, each of said intermediate plates by means of uprights 33 and axial bearings 34 being vertically displaceably mounted in bushings 35. The bushings 35 are secured in the upper tool plate 36 which, in turn, is mounted on the driven ram 37 of a press. Between the upper tool plate 36 and the intermediate plates 31 and 32, compression springs 38 act, which are stronger than the compression springs 9 and which retain the intermediate plates 31, usually in the lower end position shown which is determined by the stops 39. The stops 39 are mounted on holders 40 which are securely connected to the upper tool plate 36 and in which the intermediate plates 31 are freely displaceable in a vertical position between the stop 39 and a shoulder **40*a***.

A holding down device 41 and 42 is located above each turntable 1 or 2. As shown in FIG. 6, the shaft 43 of the holding down device 41 is mounted vertically displaceable in a bushing 44 which, in turn, is mounted in the lower tapering part **45*a* of a sleeve 45. The vertical movement clearance of the shaft 43 is determined by a cross pin 46 and a bore of elongate cross-section in the shaft 43. The sleeve 45 is mounted vertically displaceable in a bush 47 and is retained in a lower end position by a compression spring 48, which end position is determined by the flange 45*b* of the sleeve 45 stopping against the upper end face of a holder 49 for the bush 47. The lower tapered end 45*a* of the sleeve 45 passes, with some clearance, through a bore of the intermediate plate 31**.

As shown in FIG. 5, only for the alignment position shown on the right-hand side are horizontal and vertical axle ball bearings 50 and 51 connected to the intermediate plates 31 and 32, which serve as vertical and horizontally acting guide elements for covers 25 loosely supported on the turntables 1 and 2. The guide bearings 50 and 51 are shown in FIG. 1 only at one position, but are, in fact, located at four positions, as shown by FIG. 7.

Each of the turntables 1 and 2 have a stop device associated therewith, which device is connected to the associated intermediate plate 31 or 32. These stop devices are only partly shown in FIG. 5. The stop device associated with the turntable 1 is shown in FIG. 8. This stop device has a first stop ram 53, which is retained by a compression spring 54 acting thereon in the lower end position shown, which is determined by an adjustable stop nut **53*a*. The stop ram 53, at its lower end, has an asymmetrical stop surface with an inclined surface 56, whereby the shape of the inclined surface corresponds exactly to the shape of a raised portion 57 impressed in each cover. A stop ram 58, also vertically displaceable, is located parallel to the stop ram 53. The lower end position of the stop ram 58 is determined by a stop nut 58*a* and the lower end of ram 58 is also provided with an inclined surface formed exactly like the lower end of the stop ram 53. The two stop rams are coupled by a lever 59, such that only one ram at a time can assume its lower effective stop position which, in the situation assumed, is taken by the ram 53. The lever 59 projects beyond the stop ram 53 and is provided at its protruding end with a stop surface 60 and an arched control surface 61. A lever 62, having an inclined control surface 63, is pressed by a compression spring 64 against the stop surface 60 of the lever 59 without, however, being able in the position shown to move this lever. A stop ledge 65 is provided over the lever 63, which edge is connected to one of the supports 19. The lever 62 is pivotally mounted on a pin 66**.

A rigid stop device having a stop shaft 67 is mounted with the intermediate plate 32, over the turntable 2. The lower end of the stop shaft 67 has a substantially semicircular stop surface 68 (FIG. 7). When the raised portion 57 of a cover strikes against the stop surface 68 of the stop shaft 67 in accordance with FIG. 7, the raised portion 57 stops symmetrically to the longitudinal medial axis of the alignment station.

The apparatus illustrated operates in the following manner:

The upper tool plate 36, per working cycle of the press, has a vertical reciprocating movement of a definite stroke imparted thereto, for example, about 50 mm. The Figures show the apparatus in a phase of the working stroke, in which the upper tool plate 36 and the intermediate plates 31 and 32 retained by the springs 38 have already been lowered from their upper end position to such an extent that the intermediate plates 31 and 32 with their stop blocks 30 made of relatively soft material have stopped against the plates 7. The plates 7 have just assumed their upper end position against the stops 10. The plates 7 are carried along downwards against the pressure of the springs 8 and displaced right against the stops 17. At the same time, the horizontal axled guide wheels 50 have engaged both covers 25 at the edge located in the alignment direction and together with the now lowering covers and turntables 1 and 2 travel downwards. Also, at this instant, the holding down members 41 and 42 have impacted the covers located in the alignment station and also travel downwards therewith. At the beginning of the downward movement of the covers 25, these are pressed out of the holders 22 since the holders 22 yield somewhat resiliently outwards. When the covers and turntables 1 and 2 have reached their lower end position determined by impact of the plates 7 against the stops 17, the plates 7 and the intermediate plates 31 and 32 supported thereon stop, whilst the upper tool plate 36 is still lowered by a certain extent up to a lower reversal point. Hence, first the spring 41*a* or 42*a* of the holding down members 41 and 42 is compressed until the clearance between shaft 43 of the holding down member and the tapered sleeve portion 45*a* is cancelled, and then the spring 48, which presses the sleeve 45 downwards, is compressed, whereby the sleeve 45 in the guide bushing 47 slides upwards. The springs 38, during this relative movement, are somewhat compressed between the upper tool plate 36 and the intermediate plates 31 and 32.

As soon as the covers, during the above-described downward movement thereof, have left the holder 22, they are engaged in a clockwise direction in FIG. 7 by the permanently driven turntables 1 and 2. Already at the beginning of the engagement of the covers 25 and the turntables 1 and 2 in a downward direction, the stop pins 53 and 67 have assumed the effective position shown in FIGS. 5 and 8. Thus, if the cover at the first alignment position together with the turntable 1 is rotated, the raised portion 57 of this cover, at the latest after one turn of the cover, assumes the position shown in FIG. 4, where it stops against the stop surface 56 of the stop pin 53. This cover is hence pre-aligned, i.e. as shown in FIG. 7, the raised portion 57 of the cover stops at an angular spacing of about 30° from the longitudinal central axis of the alignment station. The cover, in the first alignment position over the turntable 1, is hence roughly aligned and, in a manner described hereinafter, in this position reaches the second alignment position on the turntable 2. Whilst the cover in the first alignment position on the turntable 1 is pre-positioned in a manner previously described, the pre-positioned cover at the second alignment position, is carried along on the turntable 2 in a clockwise direction from the position shown in FIG. 3 and impacted against the fixed stop 67 or its stop surface 68. The raised portion 57 of this cover, therefore, assumes an accurately symmetrical position relative to the longitudinal central axis of the alignment station. It is therefore also possible to state that the covers at the first alignment position on the turntable 1 are roughly orientated or aligned, whilst at the second alignment position they are finely orientated or aligned on the turntable 2 and hence have been brought into the final rotary position.

It may happen that during lowering of the intermediate plate 31 and the stop device connected therewith towards the covers or turntables 1 and 2, the lower end of the stop pin 53 impacts directly the raised portion 57 and hence is prevented from arriving in the stop position shown in FIG. 8. The stop pin 53 is herewith upwardly displaced against the pressure of the spring 54 in its holder, whereby the coupling lever 59 is pivoted substantially in an anti-clockwise direction. This causes the stop surface 60 of this lever to arrive in the region of the inclined control surface 63 of the lever 62, which control surface now engages beneath the control surface 61 of the coupling lever 59 and swings this lever further into an anti-clockwise direction, so that the stop pin 53 completely leaves the region of the raised portion 57 of the cover and releases the cover, whilst the second stop pin 58 has been pivoted downwards into the stop position. The raised portion 57 is therefore pre-positioned only at an angular spacing of about 10° in front of the central longitudinal axis of the alignment station. This pre-positioning also permits subsequently for the cover to be brought in the second alignment position on the turntable 2 into the final rotary position in the manner described. During the just described alignment operations, the upper tool plate 36 already moves upwards again, and after a certain distance the intermediate plates 31 and 32 are again lifted by the stops 39. Subject to the action of springs 9, the plates 7 follow the intermediate plates 31 until the plates 7 are stopped by the stops 10. By lifting the plates 7, the turntables 1 and 2 with the covers supported thereon are also lifted, and these covers are shifted into the aligned position in the holders 22, whereby the latter again temporarily yield resiliently outwardly. During the further upward movement of the upper tool plate 36 and the intermediate plates 31 and 32 coupled therewith, the holding down devices 41 and 42 are finally also lifted off the covers, whereby the parts 36, 31, 32, 41 and 42 arrive in an upper end position which is located above the position shown in the Figures. During the upward movement of the intermediate plate 31, the control surface 63 of the lever 62 abuts against the inclined slope of the stop ledge 65 and is returned, whereby also the stop pins 53 and 58 and the lever 59 return to the inoperative position shown.

The feed bars 21 are now displaced into the transportation position, i.e. from left to right in FIG. 5, and thus by a distance which corresponds to the distance between the axes of the turntables 1 and 2. Hence the cover pre-orientated on the turntable 1 at the first alignment position, is brought into the second alignment position on the turntable 2 and retained thereon. The cover previously finely orientated in the second alignment position on the turntable 2 arrives in the next shown processing position of the subsequent tool. The bars 21 also extend further to the left and have conveyed, for example, from a magazine, a new optionally orientated cover to the turntable 1. The rods 21 now stop in their position displaced to the left until during the next working cycle, the covers are disengaged from the holders 22 and carried along downwards. During the relatively short time during which the covers may rotate freely and are aligned, the feed bars 21 move back to the left to collect the next cover. The advance movement of the feed bars in the direction of transportation may, if necessary, occur more slowly between two successive alignment operations. The control of the feed bars 21 occurs in known manner by means of a camshaft.

The above description shows that the apparatus shown permits each cover to be accurately orientated in a certain rotary position. The deviation from the theoretically accurate position amounts at the most to 1–2°. Due to this accurate orientation, which precedes the further processing in a sequence tool, the cover may have any asymmetrical shape whereby—apart from the raised portion 57 which is intended for the subsequent application of a tab—other asymmetrical unevennesses, for example, ribs or the like, may be provided.

The alignment of the covers occurs extremely rapidly. With such an apparatus production of up to 21,000 covers per hour have been achieved. The various apparatus components therefore have to be rapidly moved and are thus subjected to high accelerations, which necessitates the use of stops or buffers made of a readily resilient material, and the execution of the various highly stressed parts of highly resistant material and in an as light as possible structure. Thus, for example, the feed bars 21 are made with cross bores, not shown, to reduce weight, and also the plates 7, 31, 32 and 36 are preferably made perforate or provided with bracing ribs. For sufficiently quick orientation of the covers, the turntable 1 is driven, for example, at 1,000 revolutions per minute. The turntable 2 may be driven more slowly because the position of the covers located thereon needs to be corrected at the most only by about 30°.

From an alignment station, the covers arrive in a sequence tool in which, apart from applying a tab at the raised portion 57, a weakening score is impressed in known manner. The weakening score 102 is already indicated in FIG. 2. As the sectional FIGS. 3*a* and 4*a* show, the weakening score is not the same depth everywhere, but at the points which extend parallel to the direction of rolling (FIG. 3*a*) are less deep than the positions extending transversely to the direction of rolling and where the higher material strength is decisive in the grain direction (FIG. 4*a*).

The remaining material thickness below the scorings at the points extending transversely to the grain direction e.g. amounts to 0.08 mm and at the points extending parallel to the direction of rolling e.g. 0.1 mm. The raised portion 57, at which later the tab is to be applied, is located in the regions of a deepermost weakening score, thus at a point where tearing is more readily effected. Between the positions of maximum and minimum depth of the weakening score, the depth varies continuously corresponding with the local strength of the material.

FIG. 10 shows an alternative embodiment of the alignment station, whereby the alignment of the cover does not occur by means of an impressed uneven position, but by means of a printed mark 103 indicated in FIG. 10. The cover is clamped between holding plates 104 which are rotatably mounted and pressed together or separated from one another by means of pneumatic cylinders 105.

In the region of the mark 103, there is a photoelectric cell 106 which acts via an amplifier 107 on an electrical valve 108, which permits the supply of compressed air via outlets A and B to the correspondingly designated inlets of actuating cylinders 109 for brake shoes 110.

Transporting rods 21 with holders 22 of a kind described in FIGS. 5 to 8 are located over the cover.

The axle of the lower holding plate 104 may be driven by a motor 111 via belt pulleys and a belt.

The frame 112 of the device as a whole may be vertically adjusted by means of a cylinder 113.

To align the cover 25', the lower holding plate 104 is rotated. When the mark 103 assumes a position below the photoelectric cell 106, the valve 108 is reversed via the amplifier 107 and abuts the brake shoe 110 by means of the cylinder 109 against the cover 25', so that it stops in a definite rotary position even if the holding plate continues to rotate. The frame 112 is lifted by means of the cylinder 113 and the edge of the cover moved into the holder 22 of the transporting rods 21. The cylinders 115 and 109 are now reversed and hence the plates 104 and the brake shoes 110 lifted off the cover. Now an aligned cover is conveyed away and a new one supplied which then, by renewed reversal of the cylinder 113 and the cylinders 105, is removed from the holders 22 and engaged by the holding plates 104. Then a further alignment operation begins by driving the holding plate 104 and the cover 25' and stopping the cover in a correct position by applying the brake shoes 110.

The alignment of the cover, especially unprinted covers, however, may also be effected by way of rolling tracks directly before entry in the impressing and punching device. The direction of rolling e.g. may be ascertained by optical scanning or sensing and the cover accordingly aligned. It is, however, also possible to effect mechanical sensing, whereby the cover e.g. like a record rotates beneath a sensing head provided with a sensing needle and thereby the sheet surface ascertained and the cover retained in a correct position and then conveyed into the impressing and punching device.

The above-described alignment stations are necessary only when the orientation of the covers after punching from the sheet metal strips or sheets is lost, i.e. when the covers after punching are transported in indefinite position to the sequence tool for embossing weakening scorings and application of the tab. However, the case is also conceivable that the covers in a production plant are progressively transported away from punching always in a definite orientation for all operations. In this case, one alignment station could be omitted and the covers in the orientation or rotary position with respect of the direction of rolling and/or printing arrive at all processing positions.

I claim:

1. A method for producing a cover for an easy-open tin, can or the like, wherein a cover blank is punched from the cover material, said blank being introduced into an apparatus for embossing a weakening score therein, and is aligned in accordance with its grain direction whereby said weakening score is made deeper in the portions extending transverse to the grain direction than in the portions extending parallel to the grain direction.

2. A method as recited in claim 1, wherein a tearing open device is applied to said cover at a point where the weakening score is at its maximum depth.

3. A method as recited in claim 1, wherein the depth of the weakening score varies continuously.

4. A method as recited in claim 1 wherein each said cover, during punching from said sheet metal panel, is provided with symbols, by means of which symbols said covers are aligned before introduction into said embossing apparatus for said weakening score to be embossed thereon.

5. A method as recited in claims 1, in which the structure of the punched out cover is sensed by optical or mechanical sensing means and each cover is aligned in accordance with said sensed structure before being inserted in said embossing apparatus for said weakening score to be embossed thereon.

6. A method as recited in claim 1, for producing covers having an asymmetrical unevenness, wherein said unevenness is produced at the latest during punching of the cover from a sheet metal and wherein said cover, on entry into further processing devices, is brought into a predetermined rotary position by means of its unevennesses.

7. A method as recited in claim 6 for producing covers having a tab, in which during punching, a raised portion is drawn for applying said tab thereto.

8. A method as recited in claim 1, wherein the surface of each of said cover is printed before punching.

9. A cover for an easy-open can or tin, having a weakening score for tearing said cover open, wherein said weakening score in regions transverse to the direction of grain of said cover is made deeper than said weakening score parallel to the direction of grain.

10. A cover as recited in claim 9, wherein said tearing open device is mounted on a portion of said cover of maximum depth of said weakening score.

* * * * *